US012649965B2

(12) United States Patent
Kawai et al.

(10) Patent No.: US 12,649,965 B2
(45) Date of Patent: Jun. 9, 2026

(54) STAINLESS STEEL FOIL WITH FLATTENING FILM

(71) Applicant: NIPPON STEEL Chemical & Material Co., Ltd., Tokyo (JP)

(72) Inventors: Shouhei Kawai, Tokyo (JP); Hiroto Unno, Tokyo (JP); Jun Nakatsuka, Tokyo (JP)

(73) Assignee: NIPPON STEEL CHEMICAL & MATERIAL CO., LTD., Tokyo (JP)

( * ) Notice: Subject to any disclaimer, the term of this patent is extended or adjusted under 35 U.S.C. 154(b) by 121 days.

(21) Appl. No.: 18/561,574

(22) PCT Filed: May 16, 2022

(86) PCT No.: PCT/JP2022/020419
§ 371 (c)(1),
(2) Date: Nov. 16, 2023

(87) PCT Pub. No.: WO2022/244744
PCT Pub. Date: Nov. 24, 2022

(65) Prior Publication Data

US 2024/0254607 A1 Aug. 1, 2024

(30) Foreign Application Priority Data

May 17, 2021 (JP) ..... 2021-083414

(51) Int. Cl.

| | |
|---|---|
| ***C22C 38/52*** | (2006.01) |
| ***B22F 3/15*** | (2006.01) |
| ***B22F 3/17*** | (2006.01) |
| ***B22F 3/24*** | (2006.01) |
| ***B22F 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/50*** | (2006.01) |

(52) U.S. Cl.
CPC ..... *C22C 38/52* (2013.01); *B22F 3/15* (2013.01); *B22F 3/17* (2013.01); *B22F 3/24* (2013.01); *B22F 9/082* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/50* (2013.01); *B22F 2003/248* (2013.01); *B22F 2009/0824* (2013.01); *B22F 2301/35* (2013.01); *B22F 2998/10* (2013.01); *B22F 2999/00* (2013.01)

(58) Field of Classification Search
CPC ..... C22C 38/52; C22C 38/001; C22C 38/002; C22C 38/02; C22C 38/04; C22C 38/06; C22C 38/22; C22C 38/28; C22C 38/50; C22C 38/44; C22C 33/0285; C22C 33/02; C22C 38/34; C22C 38/58; B22F 3/15; B22F 3/17; B22F 3/24; B22F 9/082; B22F 2003/248; B22F 2009/0824; B22F 2301/35; B22F 2998/10; B22F 2999/00; B22F 5/006; B22F 3/18; B22F 2003/153; C21D 2211/001; C21D 8/0205; C21D 8/021; C21D 9/46; C21D 8/0236; C21D 8/0284; B05D 1/26; C23C 26/00
USPC ..... 428/220
See application file for complete search history.

(56) References Cited

U.S. PATENT DOCUMENTS

| | | | |
|---|---|---|---|
| 6,187,452 | B1 | 2/2001 | Muto et al. |
| 2017/0313903 | A1 | 11/2017 | Yamada et al. |
| 2018/0272397 | A1 | 9/2018 | Ehara et al. |
| 2023/0077573 | A1 | 3/2023 | Sakaizawa et al. |

FOREIGN PATENT DOCUMENTS

| | | | |
|---|---|---|---|
| JP | 3-61322 | A | 3/1991 |
| JP | 2000-273586 | A | 10/2000 |
| JP | 2003-247078 | A | 9/2003 |
| JP | 2005-290449 | A | 10/2005 |
| JP | 2011-202253 | A | 10/2011 |
| WO | WO 2016/076399 | A1 | 5/2016 |
| WO | WO 2017/056618 | A1 | 4/2017 |
| WO | WO 2020/251002 | A1 | 12/2020 |
| WO | WO 2021/172381 | A1 | 9/2021 |
| WO | WO 2022/014307 | A1 | 1/2022 |

*Primary Examiner* — Megha M Gaitonde
(74) *Attorney, Agent, or Firm* — Birch, Stewart, Kolasch & Birch, LLP

(57) ABSTRACT

Stainless steel foil with a flattening film reducing the number of pits present on the stainless steel foil surface and free of cracks occurring at the flattening film, that is, stainless steel foil with a flattening film, comprising the stainless steel foil having a composition comprising stainless steel constituents and having a balance comprised of Fe and impurities, inclusions having particle diameter 2.00 μm or more comprising $Al_2O_3$: 30 mass % or less and MgO: 10 mass % or less with respect to a total mass of the particle diameter 2.00 μm or more inclusions, among the particle diameter 2.00 μm or more inclusions, the number of inclusions having particle diameter more than 5.00 μm present on the surface being 20/cm$^2$ or less, and having a sheet thickness of 5.0 μm or more and 100.0 μm or less and the flattening film having a film thickness of 0.3 μm or more and 5.0 μm or less on at least one surface of the stainless steel foil.

9 Claims, No Drawings

STAINLESS STEEL FOIL WITH FLATTENING FILM

FIELD

The present invention relates to stainless steel foil with a flattening film which is able to be used for a flexible substrate of an electronic device.

BACKGROUND

Materials for substrates for thin film electronic devices such as flexible electronic devices are required to provide flatness, insulation reliability, heat resistance, a gas barrier property, and high toughness. As candidates for this substrate material, plastic film and ultrathin glass may be mentioned, but plastic film has issues in heat resistance and gas barrier property while ultrathin glass is low in toughness and has issues in reliability. On the other hand, stainless steel foil is excellent in heat resistance, gas barrier property, and toughness, but has issues in flatness and insulating ability. Therefore, to solve these problems, the focus has been on stainless steel foil with a flattening film comprised of stainless steel foil on one surface of which a flattening film is formed to impart flatness and insulating ability. Among these, stainless steel foil with a flattening film coated with a silica-based inorganic-organic hybrid material excellent in heat resistance has become promising.

Stainless steel foils coated with silica-based inorganic-organic hybrid materials are described in PTLs 1, 2, etc.

PTL 1 describes stainless steel foil coated with a silica-based inorganic-organic hybrid materials excellent in heat resistance, workability, flatness, pliability, and insulating ability. This stainless steel foil is obtained by coating an inorganic-organic hybrid film prepared using the sol-gel method and containing a suitable number of organic groups, on one or both surfaces of stainless steel foil to thereby produce stainless steel foil excellent in heat resistance, workability, flatness, insulating ability, etc.

PTL 2 describes a short-time curing type flattening film-forming coating solution able to flatten the surface of a metal foil coil by the roll-to-roll process to the level of a glass substrate, a flattening film having both heat resistance and moisture resistance, and a metal foil coil flattened by the same. This metal foil coil is obtained by a short-time curable flattening film-forming coating solution obtained by adding to phenyltrialkoxysilane 1 mole an organic medium acetic acid 0.1 mole or more and 1 mole or less and organotin 0.005 mole or more and 0.05 mole or less as a catalyst, hydrolyzing this by 2 moles or more and 4 moles or less of water, then distilling off under reduced pressure the organic solvent at a 160° C. or more and 210° C. or less temperature, and dissolving the obtained resin in an aromatic hydrocarbon-based solvent.

On the other hand, there is the issue that even if providing the above such flattening film, due to pits in the stainless steel foil surface, cracks form in the flattening film and the flatness and insulating ability fall. Pits in the stainless steel foil surface form due to inclusions in the stainless steel dropping off from the stainless steel foil surface at the time of rolling.

Various methods have been studied for reducing the inclusions in the stainless steel used as the base material for producing stainless steel foil. For example, PTL 3 discloses stainless steel sheet suitable for members of HDD (hard disk drives) and substrates for forming semiconductor layers such as substrates for thin film silicon solar batteries and other precision equipment materials. The presence of micro pits spread around the surface of stainless steel sheet greatly affects the cleanliness of the stain steel sheet. It is disclosed that these micro pits are due to inclusions, carbide particles, etc. dropping off in the rolling process. PTL 3 discloses to form nonmetallic inclusions mainly comprised of Mn(O, S)—$SiO_2$ and render the nonmetallic inclusions harmless by adjusting the MgO, $Al_2O_3$, and $Cr_2O_3$ to predetermined concentrations or less.

CITATIONS LIST

Patent Literature

[PTL 1] Japanese Unexamined Patent Publication No. 2003-247078

[PTL 2] WO2016/076399

[PTL 3] Japanese Unexamined Patent Publication No. 2011-202253

SUMMARY

Technical Problem

The present invention has as its object to provide stainless steel foil with a flattening film reducing the number of pits present on the stainless steel foil surface causing cracks to form at the flattening film and excellent in flatness and insulation reliability.

Solution to Problem

The inventors formed a thickness 2.0 μm or more and 4.0 μm or less flattening film of a phenylsiloxane polymer on the surface of stainless steel foil to prepare a test piece. An electrode of a cross-sectional area of 4 $mm^2$ or more and 9 $mm^2$ or less impregnated with a liquid of a conductivity of 0.1 S/m or more and 100 S/m or less on the film was used as an upper electrode, the stainless steel foil was used as a lower electrode, and the surface of the test piece was scanned by the upper electrode. The number of locations where the leakage current at the time of applying 10V between the upper electrode and the lower electrode was 1 $\mu A/mm^2$ or more was measured. As a result, the inventors found several locations showing a current value of 1 $\rho A/mm^2$ or more in a measurement area of 100 $cm^2$. When examining their cross-sections, they discovered that at the surface of the stainless steel foil, there were pits of a width of 5 μm or more in a direction vertical to the rolling direction and that these pits became factors in the formation of cracks. Further, they discovered that the pits on the stainless steel foil surface occur due to coarse inclusions of a particle diameter of 5 μm or more in the stainless steel dropping off in the process of rolling of the stainless steel foil.

Furthermore, as a result of research, they discovered that while it is impossible to track dropped off inclusions, the greater the number of coarse inclusions remaining on the stainless steel foil surface and not dropping off, the greater the number of pits due to the inclusions dropping off and the greater the number of cracks formed at the flattening film formed on the stainless steel foil surface.

Therefore, they discovered that by suppressing the coarse inclusions remaining at the stainless steel foil after foil rolling, the stainless steel foil with a flattening film is greatly improved in insulating ability and flatness.

The inventors focused on $Al_2O_3$, MgO, $SiO_2$, CaO, Mn(O, S), and CrS as basic constituents of inclusions. They discovered that in the case of inclusions comprised of at least one of $SiO_2$, CaO, Mn(O, S), and CrS among them, these inclusions become resistant to clustering and, further, have a low melting point and are soft, so are stretched or crushed at the hot rolling step or cold rolling step whereby the coarse inclusions can be decreased. ($SiO_2$, CaO, Mn(O, S), and CrS are sometimes called "soft inclusions".)

On the other hand, alumina ($Al_2O_3$), magnesium-aluminum spinel ($MgO \cdot Al_2O_3$, below, sometimes referred to as "spinel"), and other inclusions are high in interfacial energy and easily become segregated and agglomerate in the process of solidification, so the size after agglomeration easily becomes larger. Further, alumina and spinel inclusions are hard, so in hot rolling and cold rolling, the inclusions become hard to crush and as a result remain as large size inclusion particles. (Alumina and magnesium-aluminum spinel are sometimes called "hard inclusions".)

Therefore, the inventors discovered that by reducing the ratio of alumina and spinel contained in the inclusions and reviewing the manufacturing conditions of the stainless steel foil, in particular the rolling conditions, so as to reduce the number of coarse alumina and spinel inclusions and finely disperse the soft inclusions, it is possible to obtain stainless steel foil reduced in coarse inclusions.

According to the present invention, the following are provided:

(1) A stainless steel foil with a flattening film, comprising
- the stainless steel foil having a composition comprising stainless steel constituents and having a balance comprised of Fe and impurities,
- inclusions having particle diameter 2.00 μm or more comprising $Al_2O_3$:30 mass % or less and MgO: 10 mass % or less with respect to a total mass of the particle diameter 2.00 μm or more inclusions,
- among the particle diameter 2.00 μm or more inclusions, the number of inclusions of more than particle diameter 5.00 μm present on the surface being 20/cm$^2$ or less, and
- having a sheet thickness of 5.0 μm or more and 100.0 μm or less and
- a flattening film having a film thickness of 0.3 μm or more and 5.0 μm or less on at least one surface of the stainless steel foil.

(2) The stainless steel foil with a flattening film according to (1), wherein the stainless steel foil is austenitic stainless steel foil which has a composition comprising, by mass %, C: 0.150% or less,
Si: 0.100 to 2.000%,
Mn: 0.100 to 10.000%,
P: 0.045% or less,
S: 0.007% or less,
Ni: 2.000 to 15.000%,
Cr: 15.000 to 20.000%,
N: 0.200% or less,
Al: 0.030% or less,
Mg: 0.0005% or less, and
Ca: 0.0005% or less and
having a balance comprised of Fe and impurities.

(3) The stainless steel foil with a flattening film according to the above (1), wherein the stainless steel foil is ferritic stainless steel foil which has a composition comprising, by mass %, C: 0.120% or less,
Si: 2.000% or less,
Mn: 0.100 to 1.250%,
P: 0.040% or less,
S: 0.030% or less,
Cr: 16.000 to 20.000%,
N: 0.025% or less,
Al: 0.030% or less,
Mg: 0.0005% or less, and
Ca: 0.0005% or less and
having a balance of Fe and impurities.

(4) The stainless steel foil with a flattening film according to any one of the above (1) to (3), wherein the flattening film is a silica-based organic-inorganic hybrid film and the Si nuclei forming the organic-inorganic hybrid film include only T nuclei and Q nuclei.

(5) The stainless steel foil with a flattening film according to (4), wherein the flattening film is a silica-based organic-inorganic hybrid film and a ratio of Q nuclei with respect to the Si nuclei forming the organic-inorganic hybrid film is 70% or less.

Advantageous Effects of Invention

It is possible to provide stainless steel foil with a flattening film comprised of stainless steel foil with few coarse inclusions on which a flattening film is formed to improve the flatness and insulation reliability.

DESCRIPTION OF EMBODIMENTS

The stainless steel foil with a flattening film of the present invention will be explained next. Unless otherwise noted, the "%" relating to the constituents shows the mass % in the steel. If no specific lower limit is specified, a case of non-inclusion (0%) may also be included.

The stainless steel foil according to the present invention is not particularly limited. For example, it may be a SUS304 or other austenite-based foil or may be a SUS430 or other ferrite-based one.

[Composition of Stainless Steel Foil]

If the stainless steel foil according to the present invention is an austenitic stainless steel foil, the stainless steel foil has a composition containing, by mass %, C: 0.150% or less, Si: 0.050 to 2.000%, Mn: 0.100 to 10.000%, P: 0.045% or less, S: 0.007% or less, Ni: 2.000 to 15.000%, Cr: 15.000 to 20.000%, N: 0.200% or less, Al: 0.030% or less, Mg: 0.0005% or less, and Ca: 0.0005% or less and having a balance of Fe and impurities.

Ni has an effect of improvement of corrosion resistance and improvement of workability and further is a main constituent for adjusting the coefficient of thermal expansion of stainless steel. From the viewpoint of improvement of the corrosion resistance, the Ni content is 2.000% or more. However, Ni is an expensive element. If the content is too high, after hot rolling or after hot forging, bainite structures easily are formed in the steel. Therefore, the Ni content is made 15.000% or less.

Cr is an alloy constituent required for improvement of the corrosion resistance. However, if an excessive amount of Cr is contained, the steel material becomes hard and the workability deteriorates, so the Cr content is 20.000% or less. The lower limit of the Cr content is not particularly prescribed, but with a 15.000% or more content, the effect of Cr addition becomes remarkable, so it is 15.000% or more.

C (carbon) need not particularly be contained. If C is excessively contained, the coefficient of thermal expansion becomes larger and the Cr-based inclusions precipitating at the crystal grain boundaries increase and become causes of formation of large inclusion particles. Therefore, the content of C is 0.150% or less, preferably 0.100% or less, more preferably 0.050% or less.

Ca is solidly soluble in sulfides to cause the sulfides to finely disperse and make the shape of the sulfides spherical. On the other hand, if containing a large amount of Ca, the Ca which was not solidly soluble in the sulfides forms coarse oxides and is liable to cause etching defects. Therefore, while it need not particularly be contained, if contained, the amount of Ca is 0.0005% or less, preferably 0.0001% or less.

Mn is proactively used as a deoxidizer in place of Mg and Al so as to avoid the formation of spinel. However, if the Mn content is too high, it segregates at the grain boundaries to aggravate grain boundary fracture and the hydrogen embrittlement resistance conversely becomes lower.

Therefore, the Mn content is 10.000% or less, preferably 5.000% or less, 2.000% or less, 1.500% or less, 1.200% or less, and 1.000% or less, more preferably 0.800% or less, 0.600% or less, and 0.500% or less. The lower limit of Mn is not particularly prescribed. However, if the Mn content is too small, it becomes difficult to adjust the inclusions to Mn(O,S)—$SiO_2$-based compositions. Therefore, Mn is 0.100% or more. Here, Mn(O,S) indicates MnO alone, MnS alone, and composite inclusions of MnO and MnS. The ratio of O and S is not constant. It means composite inclusions of oxides and sulfides.

To avoid the formation of spinel, instead of deoxidation by Mg and Al, deoxidation by Mn and Si is proactively performed. However, Si causes the coefficient of thermal expansion of stainless steel to increase. Further, the deoxidation product MnO—$SiO_2$ is vitrified soft inclusions and is stretched and split during hot rolling to be broken down. For this reason, the hydrogen embrittlement resistance rises. On the other hand, if the Si content is more than 2.000%, the strength becomes too high resulting in hardening. When cold rolling to produce thin sheet, a large number of passes are required for rolling the steel down to a predetermined sheet thickness and the productivity greatly drops. For this reason, Si is 2.000% or less, preferably 1.000% or less or 0.500% or less, more preferably 0.300% or less. The lower limit of Si is not particularly prescribed, but if too small, the steel becomes insufficiently deoxidized, the $Cr_2O_3$ concentration in the inclusions increases, and inclusions causing work cracks become easily formed. Therefore, the lower limit of Si is 0.050%, preferably 0.100%.

Mg is used for deoxidation of the steel. However, if the Mg content is more than 0.0005%, coarse inclusions are liable to be formed. Further, to avoid the formation of spinel, the content of Mg is preferably low. Therefore, the Mg content is 0.0005% or less, preferably 0.0003% or less or 0.0002% or less, more preferably 0.0001% or less.

Al is also used for deoxidation of the steel. However, if the Al content is more than 0.030%, coarse inclusions are formed and etching defects are liable to occur. Further, to avoid the formation of spinel, the content of Al is preferably low. Therefore, the Al content is 0.030% or less, preferably 0.020% or less or 0.010% or less, more preferably 0.005% or less.

P and S are elements which bond with Mn and other alloy elements in an iron-based alloy to form inclusions, so the contents are preferably small. Therefore, the P content is 0.045% or less, preferably 0.010% or less or 0.007% or less, more preferably 0.005% or less. The S content is 0.007% or less, more preferably 0.005% or less.

N, like C, is a solid solution strengthening element. If included in a large amount, the 0.2% yield strength rises and the steel material hardens. On the other hand, if included in a large amount, the manufacturability remarkably deteriorates, so the upper limit of the N content is 0.200%.

The balance of the above steel composition is comprised of Fe and unavoidable impurities. The "unavoidable impurities" here, mean constituents which enter due to various factors in the production process such as the ore, scrap, or other raw materials when industrially producing steel and which are allowed in a range not detrimentally affecting the present invention.

When the stainless steel foil according to the present invention is a ferrite-based stainless steel foil, the stainless steel foil has a composition containing, by mass %, C: 0.120% or less, Si: 0.050 to 2.000%, Mn: 0.100 to 1.250%, P: 0.040% or less, S: 0.030% or less, Cr: 15.000 to 20.000%, N: 0.025% or less, Al: 0.030% or less, Mg: 0.0005% or less, and Ca: 0.0005% or less and having a balance of Fe and impurities.

Cr is an alloy constituent required for improvement of the corrosion resistance. However, if an excessive amount of Cr is contained, the steel material hardens and the workability deteriorates, so the Cr content is 20.000% or less. The lower limit of the Cr content is not particularly prescribed, but with a 15.000% or more content, the effect of Cr addition becomes remarkable, so it is 15.000% or more.

C (carbon) need not particularly be contained. If C is excessively contained, the coefficient of thermal expansion becomes greater and Cr-based inclusions precipitating at the crystal grain boundaries increase and become causes of formation of large inclusion particles. Therefore, the content of C is 0.120% or less, preferably 0.100% or less, more preferably 0.050% or less.

Ca is solidly soluble in sulfides to cause the sulfides to finely disperse and makes the sulfides spherical in shape. On the other hand, if containing Ca in a large amount, the Ca which was not solidly soluble in the sulfides forms coarse oxides and are liable to cause etching defects. Therefore, while it need not particularly be contained, if contained, the amount of Ca is 0.0005% or less, preferably 0.0001% or less.

Mn is proactively used as a deoxidizer in place of Mg and Al so as to avoid the formation of spinel. However, if the Mn content is too high, it segregates at the grain boundaries to aggravate grain boundary fracture and the hydrogen embrittlement resistance conversely becomes lower.

Therefore, the Mn content is 1.250% or less. Preferably, it is 0.800% or less or 0.600% or less, more preferably 0.500% or less. However, if the Mn content is too small, it becomes difficult to adjust the inclusions to Mn(O,S)—$SiO_2$-based compositions. Therefore, Mn is 0.100% or more. Here, Mn(O,S) indicates MnO alone, MnS alone, and composite inclusions of MnO and MnS. The ratio of O and S is not constant. It means composite inclusions of oxides and sulfides.

Regarding Si, to avoid the formation of spinel, instead of deoxidation by Mg and Al, deoxidation by Mn and Si is proactively performed. However, Si causes the coefficient of thermal expansion of stainless steel to increase. Further, the deoxidation product MnO—$SiO_2$ is vitrified soft inclusions and is stretched and split during hot rolling to be broken down. For this reason, the hydrogen embrittlement resistance rises. On the other hand, if the Si content is more than 2.000%, the strength becomes too high resulting in hardening. When cold rolling to produce thin sheet, a large number of passes are required for rolling the steel down to a predetermined sheet thickness and the productivity greatly drops. For this reason, Si is 2.000% or less, more preferably 1.000% or less or 0.500% or less, more preferably 0.300% or less. The lower limit of Si is not particularly prescribed, but if too small, the steel becomes insufficiently deoxidized, the $Cr_2O_3$ concentration in the inclusions increases, and inclusions causing work cracks become easily formed. Therefore, the lower limit of Si is 0.050%, preferably 0.100%.

Mg is used for deoxidation of the steel. However, if the Mg content is more than 0.0005%, coarse inclusions are liable to be formed. Further, to avoid the formation of spinel, the content of Mg is preferably low. Therefore, the Mg content is 0.0005% or less, preferably 0.0003% or less or 0.0002% or less, more preferably 0.0001% or less.

Al is also used for deoxidation of the steel. However, if the Al content is more than 0.030%, coarse inclusions are formed and etching defects are liable to occur. Further, to avoid the formation of spinel, the content of Al is preferably low. Therefore, the Al content is 0.030% or less, preferably 0.020% or less or 0.010% or less, more preferably 0.005% or less.

P and S are elements which bond with Mn and other alloy elements in an iron-based alloy to form inclusions, so the contents are preferably small. Therefore, the P content is 0.040% or less, preferably 0.010% or less or 0.007% or less, more preferably 0.005% or less. The S content is 0.030% or less, preferably 0.010% or less or 0.007% or less, more preferably 0.005% or less.

N, like C, is a solid solution strengthening element. If included in a large amount, the 0.2% yield strength rises and the steel material hardens. On the other hand, if included in a large amount, the manufacturability remarkably deteriorates, so the upper limit of the N content is 0.025%.

The balance of the above steel composition is comprised of Fe and impurities. The "impurities" here mean constituents which enter due to various factors in the production process such as the ore, scrap, or other raw materials when industrially producing steel and which are allowed in a range not detrimentally affecting the present invention.

[Inclusions]

The fewer the inclusions the better. Ideally none are present at all, but they enter in the production process or are formed from the steel constituents, so totally eliminating them is not easy. As explained above, it was learned that during rolling, the coarse inclusions at the surface drop off and easily become causes of pits. Therefore, it is important to make large particle size inclusions having circle equivalent diameter 5 μm or more decrease as much as possible.

The inventors focused on $Al_2O_3$, MgO, $SiO_2$, CaO, Mn(O, S), and CrS as the basic constituents of inclusions. Among these, in the case of the soft inclusions of $SiO_2$, CaO, Mn(O, S), and CrS, it was learned that these inclusions are resistant to clustering, are low in melting point, and are soft, so are stretched or crushed by rolling thereby suppressing coarsening. On the other hand, alumina or magnesium-aluminum spinel and other hard inclusions are high in interfacial energy and easily become segregated and agglomerate in the process of solidification, so the size after agglomeration easily becomes larger. Further, alumina and spinel inclusions are hard, so in rolling, the inclusions become hard to stretch and crush and as a result end up remaining as large size inclusion particles.

From these findings, the inventors thought that it was important to keep down the very formation of soft inclusions themselves while also breaking down the soft inclusions formed by adjusting the rolling conditions (for example, reduction ratio) and, on the other hand, since hard inclusions are difficult to break down by rolling, to not allow the formation of hard inclusions themselves and, further, not allow them to enter and even if formed or entering, to not allow them to agglomerate (not allow coarsening).

First, the above-mentioned steel constituents may be set so as to not cause the formation of inclusions, both soft and hard, and to secure the mechanical strength etc. as stainless steel foil.

It is important to review the process so as to not allow inclusions to enter. For example, the refractories at the time of molten metal treatment may be reviewed and refractories with little Al, Mg, etc. may be used.

Further, agglomeration of inclusions, for example, is one of the cause of the segregation and agglomeration when solidifying from a molten metal. It is not easy to avoid segregation at the time of solidification, but stirring the molten metal so that it does not agglomerate as much as possible and other methods may be considered. Furthermore, ingots may be produced by a process not using a process of solidification from a molten metal, for example, HIP (hot isostatic pressing) etc. The production process will be explained later.

The inclusions contained in the stainless steel foil of the present invention cover inclusions of a particle diameter (circle equivalent diameter) of 2.00 μm or more (below, unless otherwise indicated, sometimes simply referred to as "inclusions") due to reasons of measurement. More than particle diameter 5.00 μm coarse inclusions are harmful and should be reduced as much as possible, but while particle diameter 2.00 to 5.00 μm inclusions are preferably decreased, they are not directly harmful.

Further, hard inclusions such as alumina and spinel easily become coarse, so should be reduced as much as possible. For this reason, $Al_2O_3$ is 30 mass % or less and MgO is 10 mass % or less with respect to the total mass of particle diameter 2.00 μm or more inclusions. The fewer these hard inclusions, the better, so the ratio of $Al_2O_3$ is preferably 25 mass % or less, 20 mass % or less, 15 mass % or less, or 10 mass % or less, more preferably 5 mass % or less, 3 mass % or less, or 1 mass % or less. The ratio of MgO is preferably 8 mass % or less, 6 mass % or less, or 5 mass % or less, more preferably 4 mass % or less, 3 mass % or less, 2 mass % or less, or 1 mass % or less.

Furthermore, the stainless steel foil according to the present invention is characterized in that the number of more than circle equivalent particle diameter 5.00 μm inclusions present at the stainless steel foil surface is $20/cm^2$ or less.

According to the present invention, the ratio of the number of inclusions with a more than 5.00 μm particle diameter of the inclusions contained in the stainless steel foil covered by the flattening film must be limited to $20/cm^2$ or less at the stainless steel foil surface. Pits on the stainless steel foil surface are causes of cracks formed at the flattening film. This is because the sheet thickness becomes thinner to a certain extent and at the time of rolling after the inclusions are broken down to a certain extent, particle diameter 5.00 μm or more inclusions present at the stainless steel foil surface drop off from the stainless steel foil surface thereby causing formation of the pits.

The particle diameter of the inclusions is measured as follows: A scanning type electron microscope (SEM) is used to examine the inclusions at the stainless steel foil surface. As the SEM, for example a JSM-IT500HR made by JEOL may be used. One example of the settings of the SEM are shown below:

Detector: backscattered electron detector BED-C
Observation magnification power: 80×
Acceleration voltage: 20.0 kV
Working distance (WD): 10.0 mm
Irradiation current: 80%

Further, images acquired by the SEM were analyzed by inclusion automatic analysis software to detect the inclusions. The composition of the inclusions was analyzed by an energy dispersion type X-ray spectrograph (below, EDS apparatus). As the inclusions automatic analysis software, for example, the particle analysis mode of Aztec made by Oxford may be used. As the EDS apparatus, for example, ULTIM MAX 65 made by Oxford may be used.

In the process of discrimination of inclusions by the inclusion automatic analysis software, first the SEM images used in the inclusion automatic analysis software are acquired. Next, if particles of a circle equivalent diameter of 2.00 μm or more are detected by the inclusion automatic analysis software from the images acquired by the SEM and at least one or more of the elements of Al, Mg, Si, Ca, Mn, and S are detected by EDS, these are discriminated as inclusions. The images finished being analyzed by EDS are joined together on software and output as a single image. At that time, the circle equivalent diameter and elemental composition of the inclusions discriminated by the inclusion automatic analysis software are also acquired. The above procedure for discrimination of inclusions is repeatedly performed to measure up to the set area. For example, for the measurement area of the images, it is sufficient to perform the measurement for 10 fields, one field being the unit of measurement of 10 $cm^2$, and make the total 100 $cm^2$ as the evaluation area. Note that the diameter of a circle having the same area as the measured area of an inclusion is made the circle equivalent (circle equivalent diameter) and is referred to as the "particle diameter".

As explained above, the stainless steel foil surface was examined to find the particle diameter of the inclusions, but it is clear that the particle diameter of the inclusions presents at the stainless steel foil surface and the particle diameter of the inclusions present inside the stainless steel foil are not particularly different.

Regarding the composition of the inclusions, the inclusions discriminated by the inclusion automatic analysis software are calculated in the following way. First, the mass % value of the elements Al, Mg, Si, Ca, Mn, Cr, and S obtained by EDS analysis area are divided by the respective atomic weights to find the apparent amount of substance of the elements. Next, the above seven types of elements were rendered states of oxides or sulfides of the basic constituents of the inclusions. In the inclusions, Al, Mg, Si, and Ca is mainly present as oxides.

Mn and Cr are also mainly present as sulfides and Mn is also present as the oxide MnO. S is sometimes also present as the chrome sulfide CrS in addition to the above-mentioned sulfide MnS. If the apparent amount of substance of S is greater than the apparent amount of substance of Mn, the same amount of MnS as the apparent amount of substance of Mn is present. At this time, CrS is present in an amount of substance of the apparent amount of substance of S minus the apparent amount of substance of Mn. If the apparent amount of substance of S is smaller than the apparent amount of substance of Mn, the same amount of MnS as the apparent amount of substance of S is present. At this time, MnO is present in an amount of substance of the apparent amount of substance of Mn minus the apparent amount of substance of S. If the apparent amount of substance of Mn and the apparent amount of substance of S are completely the same amounts, the same amount of MnS as the amounts of substance of Mn and S is present.

To render the inclusions the states of oxides or sulfides of the basic constituents of the inclusions, the amount of substance of the element O (oxygen) or S corresponding to the apparent amounts of substance of the elements are imparted based on the respective stoichiometric ratios of Al:O=2:3, Mg:O=1:1, Si:O=1:2, Ca:O=1:1, Mn:O=1:1, Mn:S=1:1, S:Cr=1:1, then are multiplied with the respective molecular weights to calculate the masses converted to oxides etc. The respective masses converted to oxides etc. found are divided by the total of the seven mass % converted to oxides etc. to find the mass % converted to oxides etc. of $Al_2O_3$, MgO, $SiO_2$, CaO, MnO, MnS, and CrS (below, sometimes referred to as the "oxides etc.") The converted mass % of the seven oxides etc. with respect to the areas of the inclusions found by the inclusion automatic analysis software are respectively cumulatively added to find the inclusion areas ($\mu m^2$) of $Al_2O_3$, MgO, $SiO_2$, CaO, MnO, MnS, and CrS.

Next, the respective inclusion areas are found for all inclusions discriminated by the inclusion automatic analysis software and the inclusion areas are totaled up for each of the seven oxides or sulfides to obtain the total area of $Al_2O_3$, the total area of MgO, the total area of $SiO_2$, the total area of CaO, the total area of MnO, the total area of MnS, and the total area of CrS. The sum of the seven total areas is made the total area of all inclusions. The total area of the respective oxides etc. is divided by the total area of the full inclusions to calculate the ratio of composition (mass %) of the inclusions.

The number density of more than particle diameter 5.00 μm inclusions is made 20/$cm^2$ or less. For this reason, inclusions of a diameter causing formation of pits at the stainless steel foil surface becoming factors behind cracks of the flattening film are reduced. The fewer the more than particle diameter 5.00 μm inclusions the better. Preferably, they are 15/$cm^2$ or less, 12/$cm^2$ or less, or 10/$cm^2$ or less, more preferably 8/$cm^2$ or less, 6/$cm^2$ or less, or 5/$cm^2$ or less.

[Sheet Thickness]

The stainless steel foil used in the present invention has a sheet thickness of 5.0 μm or more and 100.0 μm or less. If the sheet thickness becomes greater than 100.0 μm, flexibility as a foil can no longer be expected and merit of lighter weight, a major feature of foil, becomes lost. Sheet thickness thinner than 5.0 μm stainless steel foil extremely easily becomes creased or wrinkled at the time of handling. This is not compatible with industrial processes. Also, the strength as a substrate falls and problems arise in reliability at the time of use. Furthermore, this thin a stainless steel foil inherently has to become high in price from an industrial perspective. Note that the sheet thickness of the stainless steel foil used in the present invention can be measured using a so-called contact type micrometer. The sheet thickness of the stainless steel foil used in the present invention is more preferably 10.0 μm or more and 80.0 μm or less for the purpose of preventing the flattening film from cracking.

The method of production of the stainless steel foil with a flattening film of the present invention will be explained next.

The stainless steel foil according to the present invention can be produced in the following way, but the method shown below is just an illustration. The invention is not intended to be limited to this method.

For example, raw materials adjusted to a predetermined composition are melted in vacuum in a $10^{-1}$ (Torr) or less vacuum atmosphere to obtain a molten metal of the targeted alloy composition. At this time, to deoxidize the molten metal, Mn and Si are added so that the contents of Mn and Si in the molten metal after slag removal become the respectively predetermined contents.

Next, Ar or $N_2$ gas or other inert gas is used to atomize (powder) the molten metal by a gas atomizer. The molten metal temperature at the time of gas atomization is preferably made the melting point +50° C. to 200° C. in range so as to lower the viscosity of the molten metal. Further, the ratio of the gas flow rate ($m^3$/min)/molten metal flow rate (kg/min) at the time of gas atomization may be made 0.3 ($m^3$/kg) or more. If the ratio of the gas flow rate ($m^3$/min)/molten metal flow rate (kg/min) is less than 0.3 ($m^3$/kg), the cooling speed of the molten droplets becomes slower, so the liquid phase ratio of the liquid drops when striking the cast ingot surface becomes too high and the inclusions become coarser.

For this reason, the ratio of the gas flow rate and molten metal flow rate is made 0.3 ($m^3$/kg) or more, preferably 0.5 or more, 0.7 or more, 0.9 or more, 1.0 or more, or 1.5 or more, more preferably 2.0 or more. The upper limit of the ratio of the gas flow rate ($m^3$/min)/molten metal flow rate is not particularly prescribed, but if 5.0 ($m^3$/kg) or more, the cooling ability becomes saturated, so the upper limit may be made 5.0 ($m^3$/kg).

The alloy powder obtained by the atomization step is sintered by the hot press method or HIP method to produce an ingot. The method of sintering is not particularly limited. Suitable conditions may be set according to the ordinary hot press method etc.

Alloy powder becomes easier to sinter the smaller the particle diameter, but compared with large particle diameter alloy powder, the productivity becomes lower. On the other hand, the larger the particle diameter of the alloy powder becomes, the easier it is liable to become for impurities to enter from the furnace materials. For this reason, the alloy powder is made a particle diameter of 300 μm or less, preferably 250 μm or less, 200 μm or less, or 150 μm or less, more preferably 100 μm or less.

Due to the above atomization (powderization) method, it is possible to keep down the contents of Al and Mg. Further, if using the sintering method of treatment in a solid phase, there will also be no entry of Al or Mg from refractories such as in the solidification method (casting method), so formation of large sized inclusions (for example, 5 μm or more) is suppressed. From these, in the end, $Al_2O_3$ and spinel-based inclusions themselves are decreased. In particular, formation of 5 μm or more coarse inclusions can be remarkably suppressed.

Next, the produced alloy ingot is hot forged or cut or is ground down to produce a steel slab. This steel slab is rolled down to 3.0 mm to 200 mm thickness. This rolling may be hot rolling or cold rolling. The 3.0 mm to 200 mm thick rolled sheet is repeatedly rolled to form sheet thickness 100.0 μm or less stainless steel foil. The lower limit of the sheet thickness is 5.0 μm to obtain the effect of the present invention.

The ingot may be annealed before or after the hot rolling, hot forging, or cold rolling. Further, the temperatures in the annealing step, hot forging step, and hot rolling step are temperatures of less than the melting point of the iron-based alloy of the present invention so as to prevent agglomeration of inclusions, preferably the melting point of the iron-based alloy of the present invention minus 500° C. or more to the melting point of the iron-based alloy of the present invention minus 200° C. or less in range.

After the hot rolling or hot forging, cold rolling may be performed. In the middle of the cold rolling, intermediate annealing may also be performed. Due to the rolling, the inclusions, in particular the soft inclusions, are stretched and crushed so the inclusions can be broken down. For breaking down the inclusions, cold rolling is more effective than hot rolling. Further, the thinner the sheet thickness, the more effective, so the total reduction ratio of the cold rolling should be made 96.0% or more based on the sheet thickness after hot rolling (sheet thickness right before cold rolling). Preferably it may be made 97.0% or more, 98.0% or more, 99.0% or more, or 99.5% or more. Furthermore, with a higher reduction ratio, a greater effect of breaking down the inclusions can be expected, so with the exception of the pass for reaching the targeted sheet thickness and the pass for correcting the shape, the reduction ratio in each pass may be made 20.0% or more. By cold rolling by such a reduction ratio, it is possible to break down and disperse the soft inclusions more by stretching and crushing.

On the other hand, in rolling after the sheet thickness becomes thinner to a certain extent and inclusions are broken down to a certain extent (finish rolling), it was learned that at the same time as the inclusions are broken down, uneven surface is formed due to inclusions dropping off or pinholes are formed passing through the stainless steel foil. For this reason, in the finish rolling (multiple stage rolling) from a sheet thickness 10 to 80 μm thicker than the final sheet thickness to the final sheet thickness, it is sufficient to perform mild rolling controlling the unit rolling loads (kN/mm) of the individual passes to suitable regions. The "unit rolling load" is the load applied from the rolling rolls to the rolled material divided by the width of the rolled material. For example, the unit rolling load may be made 0.4 to 1.3 kN/mm and the cumulative reduction ratio may be made 50.0% or more. If the unit rolling load is less than 0.4 kN/mm, there is little work generated heat along with the rolling and the alloy film of the worked material falls in flexibility, so cracks form at the interface of the inclusions and alloy foil and more inclusions drop off. Further, if more than 1.3 kN/mm, the work generated heat increases, but the amount of plastic deformation of the alloy foil itself becomes larger, so cracks form at the interface with the inclusions and more inclusions drop off. Further, if the cumulative reduction ratio of the finish rolling is less than 50.0%, sometimes the strength of the alloy foil is not manifested. The upper limit of the cumulative reduction ratio of the finish rolling is not particularly prescribed, but it may be made 98.0% or less from the normal capacity of foil rolling machines.

Furthermore, to keep down the formation of uneven surface due to inclusions dropping off, the reduction ratio of the final rolling for obtaining the final sheet thickness may be made 0.2 to 3.0%. Here, the "reduction ratio" is shown by the following formula when the sheet thickness before rolling is made t1 and the sheet thickness after the rolling is made t2.

$$\text{Reduction ratio}=(t1-t2)/t1$$

For example, for the cumulative reduction ratio in the finish rolling, even with multiple stages, the sheet thickness before the finish rolling may be made t1 and the sheet thickness after the finish rolling may be made t2. For the reduction ratio of each pass, the sheet thickness before each rolling pass may be made t1 and the sheet thickness after the rolling pass may be made t2.

Furthermore, after the finish rolling (final rolling), the foil may be annealed to remove stress.

[Composition of Flattening Film]

The flattening film used for the structure of the stainless steel foil with a flattening film of the present invention is a silica-based inorganic-organic hybrid film.

[Silica-Based Inorganic-Organic Hybrid Film]

A silica-based inorganic-organic hybrid film generally has a structure including, as basic units of silicone, $R_2Si(OR')_2$, $RSi(OR')_3$, or $Si(OR')_4$ and is obtained by coating and heat treating a coating solution hydrolyzed and condensed in a solvent. Here, R is any organic group and R' is an alkyl group. $R_2Si(OR')_2$, $RSi(OR')_3$, and $Si(OR')_4$ respectively correspond to the D nuclei (bifunctional), T nuclei (trifunctional), and Q nuclei (tetrafunctional) of Si.

The silica-based inorganic-organic hybrid film forming the flattening film, when including D nuclei of Si as a component element, can impart flexibility to the film, but during the high temperature processes when fabricating devices, at the D nuclei, three-member rings are formed and detach, so the properties of the devices are adversely affected. For this reason, a silica-based inorganic-organic hybrid film in which the Si nuclei forming the flattening film are comprised of only T nuclei and Q nuclei is sought. If the ratio of Q nuclei with respect to all Si nuclei is more than 70%, the density of Si—O bonds forming the film becomes too high. In this case, the film easily cracks, so this is unsuitable. T nuclei can impart flexibility to film since there is one organic group directly bonded with the Si. The ratio of the Q nuclei should be 70% or less.

The organic group R directly bonded with Si forming the silica-based inorganic-organic hybrid film according to the present invention is not particularly limited. For example, from the viewpoint of the heat resistance, a methyl group or phenyl group is preferable. The methyl group and phenyl group may be included respectively alone or both may be simultaneously included. The type and amount of the Si nuclei in the flattening film can be identified by 29Si-NMR measurement. The organic group directly bonded with Si can be investigated by FTIR or a combination of 13C-NMR and 1H-NMR etc.

[Coating Solution for Forming Silica-Based Inorganic-Organic Hybrid Film]

The silica-based inorganic-organic hybrid film can be prepared by various methods. If the silica-based inorganic-organic hybrid film is a phenyl group-modified silica film, it is for example prepared from a coating solution shown below. The method shown below is an illustration. The invention is not intended to be limited to this method.

This coating solution is a coating solution obtained by adding, to 1 mole of phenyltrialkoxysilane in an organic solvent, acetic acid 0.1 mole or more and 1 mole or less, and organotin 0.005 mole or more and 0.050 mole or less as catalysts, hydrolyzing this by 2.0 moles or more and 4.0 moles or less of water, then distilling off under reduced pressure at 160° C. or more and 210° C. or less of temperature the organic solvent used when hydrolyzing the phenyltrialkoxysilane and the water and alcohol reaction byproducts, and dissolving the obtained resin in an aromatic hydrocarbon-based solvent.

As the phenyltrialkoxysilane used here, phenyltrimethoxysilane, phenyltriethoxysilane, phenyltripropoxysilane, etc. may be mentioned.

As the organic solvent used when hydrolyzing phenyltrialkoxysilane, methanol, ethanol, propanol, etc. may be mentioned.

The organic solvent distilled off at the time of vacuum distillation includes the alcohol produced by hydrolysis of phenyltrialkoxysilane in addition to the organic solvent used when hydrolyzing phenyltrialkoxysilane. Further, water produced along with a condensation reaction of the hydrolyzed phenyltrialkoxysilane is also included.

As the aromatic hydrocarbon-based solvent, toluene, xylene, etc. may be mentioned. The aromatic hydrocarbon-based solvent may also have another organic solvent mixed in it in a range not impacting the properties.

An organotin compound is a catalyst promoting a polycondensation reaction of phenyltrialkoxysilane and its hydrolyzed condensation reaction product or phenyl-group containing ladder polymer. As the organotin compound, dibutyltin diacetate, bis(acetoxydibutyltin)oxide, dibutyltin bisacetylacetate, dibutyltin bismaleic acid monobutyl ester, dioctyltin bismaleic acid monobutyl ester, bis(lauroxydibutyltin)oxide, etc. may be mentioned.

The silica-based inorganic-organic hybrid film is formed by coating the above coating solution on the surface of stainless steel foil and curing it in an inert gas atmosphere at a 300° C. or more and 450° C. or less heat treatment temperature to preferably give a film thickness of 0.3 μm or more and 5.0 μm or less.

If the silica-based inorganic-organic hybrid film is a methyl group-modified silica film, for example, it is fabricated from the coating solution shown below.

Methyltriethoxysilane 0.6 mole and tetramethoxysilane 0.4 mole are hydrolyzed in 12.0 moles of ethanol by 2.0 moles of water and 0.1 mole of acetic acid and made to react by condensation. The thus obtained coating solution is coated by a film thickness of 1.0 μm, then heat treated in nitrogen at 450° C. for 10 minutes. In the film, T nuclei at which methyl groups are bonded account for 60% and Q nuclei for 40%. As the material of the Q nuclei, in addition to tetramethoxysilane, tetraethoxysilane, tetrapropoxysilane, colloidal silica, etc. can be used. Other than methyltriethoxysilane, methyltrimethoxysilane can also be used. Several of these materials may be combined.

In a silica-based inorganic-organic hybrid film, depending on the heat treatment temperature after coating and the gas atmosphere during the heat treatment, the organic groups of the organoalkoxysilane material sometimes break down by the heat resulting in the Si changing from T nuclei to Q nuclei. Therefore, the T nuclei material, for example, methyltrimethoxysilane 1.0 mole is hydrolyzed and made to condense in 8.0 moles of methanol using 3.0 moles of water and 0.01 mole of nitric acid. If the obtained coating solution is coated to a film thickness of 0.4 μm, then heat treated in nitrogen containing 0.1% of oxygen at 500° C. for 1 minute, in the flattening film, the Si of T nuclei to which methyl groups are bonded accounts for 98% and Si of Q nuclei resulting from methyl groups breaking down by heat accounts for 2%. On the other hand, if coating the coating solution to a film thickness 0.4 μm on stainless steel foil, then heat treating it in nitrogen at 500° C. for 1 minute, the Si of T nuclei to which methyl groups are bonded accounts for 100%.

The film thickness of the silica-based inorganic-organic hybrid film formed on the stainless steel foil is 0.3 μm or more and 5.0 μm or less. If thinner than 0.3 μm, the coverage of the stainless steel foil surface becomes insufficient, the stainless steel foil will short-circuit with the devices, or the surface of the silica-based inorganic-organic hybrid film will not become sufficiently flat and delamination of the electrode layer or semiconductor layer forming the device will occur, so this is unsuitable. If more than 5.0 μm, the film easily cracks. Not only do cracks easily occur at the time of film formation, but also cracks easily form when bending the stainless steel foil covered by the flattening film as a flexible substrate. The film thickness is more preferably 0.5 μm or more and 3.5 μm or less from the viewpoint of covering the stainless steel foil surface and preventing cracks.

EXAMPLES

Next, examples will be used to further explain the present invention. The present invention is of course not limited to the examples presented here.

For each of the Test Materials 1 and 2, a vacuum induction melting furnace was used to prepare a molten metal of the stainless steel alloy composition adjusted to the constituents shown in Table 1. This was powderized by gas atomization by $N_2$ gas. The molten metal temperature at the time of gas atomization was made the liquidus temperature+50° C. to the liquidus temperature +200° C. in range to lower the viscosity of the molten metal. Further, the ratio of the gas flow rate ($m^3$/min)/molten metal flow rate (kg/min) at the time of gas atomization was adjusted to 1.0 to 3.0 ($m^3$/kg).

Next, the obtained alloy powder was sealed in a metal container. The known HIP treatment method was used to produce ingots of each of the Test Materials 1 and 2.

For each of the Test Materials 3 and 4, a vacuum induction melting furnace was used to prepare a molten metal of a stainless steel alloy composition adjusted to the constituents shown in Table 1, then the melt was transferred to a casting mold and made to solidify in the mold to produce an ingot. During this time, for the refractories of the tundish in which the molten metal is placed and the inside walls of the casting mold, refractories equal to those used in normal operations were used.

The ingots of some of the Test Materials 1 and 2 and of the Test Materials 3 and 4 were hot forged to produce cross-section 80 mm×80 mm steel slabs. Each of the steel slabs was hot rolled down to 3.0 mm thickness then was cold rolled to obtain sheet thickness 0.30 mm steel sheet. The obtained steel sheet was cold rolled. Except for the pass for reaching the targeted sheet thickness and the pass for correcting the shape, the reduction ratio in each pass was made 20.0% or more to obtain steel foil with a sheet thickness 50.0 μm thicker than the final sheet thickness. The steel foil obtained from each of the Test Materials 1 and 2 was finish rolled to produce sheet thickness 5.0 μm, 10.0 μm, 25.0 μm, 50.0 μm, and 100.0 μm stainless steel foils. The steel foil obtained from each of the Test Materials 3 and 4 was finish rolled to produce sheet thickness 50.0 μm stainless steel foil. At this time, the unit rolling load was made 0.4 to 1.3 kN/mm, and the reduction ratio in the final finish rolling was made 0.2 to 3.0%. Note that tension annealing was performed to remove the strain due to the cold rolling.

The stainless steel foils produced from the Test Material 1 of the sheet thicknesses 5.0 μm, 10.0 μm, 25.0 μm, 50.0 μm, and 100.0 μm were respectively designated as the Test Materials 1-1, 1-2, 1-3, 1-4, and 1-5. The stainless steel foils produced from the Test Material 2 were similarly designated as the Test Materials 2-1, 2-2, 2-3, 2-4, and 2-5. The stainless steel foil produced from the Test Material 3 was designated as the Test Material 3-1 while the stainless steel foil produced from the Test Material 4 was designated as the Test Material 4-1.

The ingots of some of the Test Materials 1 and 2 were hot forged to produce 80 mm×80 mm steel slabs. Each of the steel slabs was hot rolled until becoming 3.0 mm thickness, then was cold rolled to obtain sheet thickness 0.30 mm steel sheet. The obtained steel sheet was cold rolled. Except for the pass for reaching the targeted sheet thickness and the pass for correcting the shape, the reduction ratio in each pass was made less than 20.0% to obtain steel foil with a sheet thickness 50.0 μm thicker than the final sheet thickness. The obtained steel foil was finish rolled to produce sheet thickness 50.0 μm stainless steel foil. At this time, the reduction ratio in the final finish rolling was made 5.0%. Note that tension annealing was performed to remove the strain due to the cold rolling. The stainless steel foil produced from the Test Material 1 was designated as the Test Material 1-6 while the stainless steel foil produced from the Test Material 2 was designated as the Test Material 2-6.

TABLE 1

| | Composition (mass %) (balance Fe and unavoidable impurities) | | | | | | | | | | | | | |
|---|---|---|---|---|---|---|---|---|---|---|---|---|---|---|
| | C | Si | Mn | Ni | Cr | N | Al | Co | Mg | Ca | Ti | Mo | P | S |
| Test Mat. 1 austenite | 0.0120 | 0.0500 | 0.2800 | 10.33 | 18.34 | 0.0200 | 0.0040 | 0.0100 | 0.0005 | 0.0040 | 0.0010 | 0.0000 | 0.0200 | 0.0005 |
| Test Mat. 2 ferrite | 0.0150 | 0.0006 | 0.0001 | 0.000 | 19.11 | 0.0200 | 0.0050 | 0.0000 | 0.0005 | 0.0040 | 0.5800 | 1.770 | 0.0200 | 0.0005 |
| Test Mat. 3 austenite | 0.0100 | 0.0500 | 0.3000 | 10.33 | 18.34 | 0.0200 | 0.0070 | 0.0100 | 0.0008 | 0.0040 | 0.0010 | 0.0000 | 0.0200 | 0.0010 |
| Test Mat. 4 ferrite | 0.0120 | 0.0004 | 0.0001 | 0.000 | 19.11 | 0.0200 | 0.0070 | 0.0000 | 0.0008 | 0.0040 | 0.5500 | 1.770 | 0.0200 | 0.0009 |

A coating solution for forming a phenyl group-containing silica-based inorganic-organic hybrid film was prepared. First, a 1 L flask was used to blend the ingredients to give the compound ratio shown in Table 2. The materials were compounded to give a total amount of 0.7 L. After compounding, the materials were stirred and mixed for 15 minutes by a magnetic stirrer. To promote hydrolysis, the mixture was refluxed at 80° C. for 3 hours under a flow of nitrogen. After that, a rotary evaporator was used to distill off the solvent under reduced pressure to obtain a condensation reaction product at a temperature setting of the oil bath of 80° C. After that, toluene was added in an equal amount as the weight of the condensation reaction product to make the condensation reaction product dissolve. This 1 L flask was connected to a refluxer with a Dean Stark trap and heated under reflux. The temperature setting of the oil bath and the reflux time at the time of heating under reflux are shown in Table 2. After heating under reflux, toluene was further added to dilute the solution to give a solids concentration of 30 mass % and a pore size 5 μm filter was set to perform filtration under reduced pressure and obtain a coating solution for forming a phenyl group-containing silica-based inorganic-organic hybrid film.

[Table 2]

TABLE 2

| | | |
|---|---|---|
| Compounding ratio [moles] | Phenyltriethoxysilane | 1.00 |
| | Ethanol | 9.00 |
| | Acetic acid | 0.80 |
| | Dibutyl diacetate tin | 0.01 |
| | Water | 9.00 |
| Oil bath temperature setting [° C.] | | 130 |
| Heating reflux time [h] | | 7 |

One surface of each stainless steel foil produced was formed with a phenyl group-containing si lica-based inorganic-organic hybrid film using a die coater to film thicknesses of 0.3, 3.0, and 5.0μ. The drying furnace had a furnace length of 3 μm, the temperature of the furnace was set to 100° C., each foil was conveyed by a speed of 5 m/min, then a PAC3J-30H slightly tacky protective film w as attached while coiling up the foil. Next, the protective film was peeled off while running the foil through a hot air drying furnace of a furnace length of 6 μm and furnace temperature of 400° C. in a nitrogen atmosphere by a conveyance speed of 1 m/min, and a PAC3J-30H slightly tacky protective film was attached while coiling up the foil to obtain a roll of a stainless steel foil with a flattening film. Using 29Si-NMR, it was confirmed that the Si nuclei were comprised of all T nuclei. Using FTIR, it was confirmed that the organic groups were phenyl groups.

A coating solution for forming a methyl group-containing silica-based organic-inorganic hybrid film was prepared. Methyltriethoxysilane 0.5 mol and tetramethoxysilane 0.5 mol were hydrolyzed in 6.0 moles of 2-ethoxyethanol by 2.0 moles of water and 0.1 mole of acetic acid and made to react by condensation, then MEK was added and mixed in 6.0 moles.

One surface of each stainless steel foil produced was formed with a methyl group-containing silica-based inorganic-organic hybrid film using a die coater to a film thickness of 1.0 μm. The drying furnace had a furnace length of 3 m, the temperature of the furnace was set to 150° C., the foil was conveyed by a speed of 5 m/min, then a PAC3J-30H slightly tacky protective film was attached while coiling up the foil. Next, the protective film was peeled off while running the foil through a hot air drying furnace of a furnace length of 6 m and furnace temperature of 420° C. in a nitrogen atmosphere by a conveyance speed of 1 m/min, and a PAC3J-30H slightly tacky protective film was attached while coiling up the foil to obtain a roll of a stainless steel foil with a flattening film. Using 29Si-NMR, it was confirmed that the Si nuclei were comprised of T nuclei and Q nuclei in 50% each. Using FTIR, it was confirmed that the organic groups were methyl groups.

Each of the stainless steel foils with a flattening film produced in the above way was evaluated for inclusions and evaluated for flatness and insulation reliability. The results are shown in Tables 3, 4, 5, 6, 7, and 8. Here, the inclusions were examined at the surface of the stainless steel foil on which the flattening film was not formed. The flatness and insulation reliability were evaluated at the surface of the stainless steel foil on which the flattening film was formed (location corresponding to back surface side of stainless steel foil surface evaluated for inclusions).

An SEM (JSM-IT500HR made by JEOL) was used to examine the inclusions on the surface of the stainless steel foil not formed with a flattening film. A correlation is seen between the number of inclusions observed at the surface of stainless steel foil not formed with a flattening film and the number of measurement points of leakage current measured at the surface where a flattening film is formed. The settings of the SEM are as follows:

Detector: backscattered electron detector BED-C
Observation magnification power: 80×
Acceleration voltage: 20.0 kV
Working distance (WD): 10.0 mm
Irradiation current: 80%

Further, images acquired by the SEM were analyzed by inclusion automatic analysis software (particle analysis mode of Aztec made by Oxford) to detect the inclusions. The composition of the inclusions was analyzed by an EDS apparatus (ULTIM MAX 65 made by Oxford).

In the process of discrimination of inclusions by the inclusion automatic analysis software, first the SEM images used in the inclusion automatic analysis software are acquired. Next, in the images acquired by the SEM, if inclusions of a circle equivalent diameter of 2.00 μm or more are detected by the inclusion automatic analysis software and at least one or more of the elements of Al, Mg, Si, Ca, Mn, and S are detected by EDS, these are discriminated as inclusions. The images finished being analyzed by EDS are joined together on software and output as a single image. At that time, the particle diameter and elemental composition of the inclusions discriminated by the inclusion automatic analysis software are also acquired. The evaluated area was made 100 $cm^2$ and the circle equivalent diameter was made the particle diameter of the inclusions.

Regarding the composition of the inclusions, the mass % converted to oxides of $Al_2O_3$ and MgO were calculated for the inclusions discriminated by the inclusion automatic analysis software.

[Number of Measurement Points of Leakage Current of 1 $\mu A/Mm^2$ or More Per 100 $cm^2$]

A flattening film was formed on the surface of each stainless steel foil to prepare a test piece. Using an electrode of a cross-sectional area of 1 $mm^2$ or more and 25 $mm^2$ or less impregnated with a liquid of a conductivity of 0.1 S/m or more and 100 S/m or less on the film as an upper electrode and using the stainless steel foil as a lower electrode, the surface of the test piece was scanned by the upper electrode. The number of locations where the leakage current at the time of applying 10V between the upper electrode and the lower electrode was 1 $\mu A/mm^2$ or more was measured.

[Flatness]

At locations of the test piece where 1 μA/mm$^2$ or more leakage current was measured, the flattening film cracked. Further, the step differences at the flattening film surface formed due to the cracks caused the flatness to fall.

A case where there were less than 10 points per 100 cm$^2$ with a leakage current of 1 μA/mm$^2$ or more was judged as "good" in flatness while a case where there were 10 or more was judged as "poor" in flatness. If 10 or more, defects in the devices remarkably increase, so less than 10 was defined as "good".

[Insulation Reliability]

A case where there were 0 to less than 10 points where a 1 μA/mm$^2$ or more leakage current was measured was evaluated as "good" in insulation reliability, while a case where there 10 or more was evaluated as "poor" in insulation reliability.

TABLE 3

| | | Ex. 1-1 | Ex. 1-2 | Ex. 1-3 | Ex. 1-4 | Ex. 1-5 | Comp. Ex. 1-1 | Comp. Ex. 1-2 |
|---|---|---|---|---|---|---|---|---|
| Stainless steel foil | Test material | Test Mat. 1-1 | Test Mat. 1-2 | Test Mat. 1-3 | Test Mat. 1-4 | Test Mat. 1-5 | Test Mat. 3-1 | Test Mat. 1-6 |
| | Sheet thickness [μm] | 5.0 | 10.0 | 25.0 | 50.0 | 100.0 | 50.0 | 50.0 |
| | $Al_2O_3$ [mass %] | 18.3 | 18.6 | 18.7 | 24.8 | 26.4 | 36.1 | 43.1 |
| | MgO [mass %] | 6.2 | 6.3 | 6.3 | 9.5 | 9.7 | 12.9 | 19.4 |
| | Number of inclusions with circle equivalent diameter of more than 5 μm [/cm$^2$] | 0.9 | 1.2 | 1.8 | 4.3 | 7.3 | 23.4 | 30.7 |
| Flattening film | Type | Phenyl group | Phenyl group | Phenyl group | Phenyl group | Phenyl group | Phenyl group | Phenyl group |
| | Film thickness [μm] | 5.0 | 5.0 | 5.0 | 5.0 | 5.0 | 5.0 | 5.0 |
| Evaluation | Number of measurement points of leakage current of 1 μA/mm$^2$ or more per 100 cm$^2$ [No.] | 1.7 | 1.7 | 2.0 | 2.3 | 3.4 | 38.0 | 55.0 |
| | Insulation reliability | Good | Good | Good | Good | Good | Poor | Poor |
| | Flatness | Good | Good | Good | Good | Good | Poor | Poor |

TABLE 4

| | | Ex. 2-1 | Ex. 2-2 | Ex. 2-3 | Ex. 2-4 | Ex. 2-5 | Comp. Ex. 2-1 | Comp. Ex. 2-2 |
|---|---|---|---|---|---|---|---|---|
| Stainless steel foil | Test material | Test Mat. 1-1 | Test Mat. 1-2 | Test Mat. 1-3 | Test Mat. 1-4 | Test Mat. 1-5 | Test Mat. 3-1 | Test Mat. 1-6 |
| | Sheet thickness [μm] | 5.0 | 10.0 | 25.0 | 50.0 | 100.0 | 50.0 | 50.0 |
| | $Al_2O_3$ [mass %] | 18.3 | 18.6 | 18.7 | 24.8 | 26.4 | 36.1 | 43.1 |
| | MgO [mass %] | 6.2 | 6.3 | 6.3 | 9.5 | 9.7 | 12.9 | 19.4 |
| | Number of inclusions with circle equivalent diameter of more than 5 μm [/cm$^2$] | 0.9 | 1.2 | 1.8 | 4.3 | 7.3 | 23.4 | 30.7 |
| Flattening film | Type | Phenyl group | Phenyl group | Phenyl group | Phenyl group | Phenyl group | Phenyl group | Phenyl group |
| | Film thickness [μm] | 3.0 | 3.0 | 3.0 | 3.0 | 3.0 | 3.0 | 3.0 |
| Evaluation | Number of measurement points of leakage current of 1 μA/mm$^2$ or more per 100 cm$^2$ [No.] | 2.7 | 2.8 | 2.9 | 3.7 | 4.5 | 37.0 | 53.0 |
| | Insulation reliability | | | | | | | |
| | Flatness | Good | Good | Good | Good | Good | Poor | Poor |
| | Insulation reliability | Good | Good | Good | Good | Good | Poor | Poor |

TABLE 5

| | | Ex. 3-1 | Ex. 3-2 | Ex. 3-3 | Ex. 3-4 | Ex. 3-5 | Comp. Ex. 3-1 | Comp. Ex. 3-2 |
|---|---|---|---|---|---|---|---|---|
| Stainless steel foil | Test material | Test Mat. 1-1 | Test Mat. 1-2 | Test Mat. 1-3 | Test Mat. 1-4 | Test Mat. 1-5 | Test Mat. 3-1 | Test Mat. 1-6 |
| | Sheet thickness [μm] | 5.0 | 10.0 | 25.0 | 50.0 | 100.0 | 50.0 | 50.0 |
| | $Al_2O_3$ [mass %] | 18.3 | 18.6 | 18.7 | 24.8 | 26.4 | 36.1 | 43.1 |
| | MgO [mass %] | 6.2 | 6.3 | 6.3 | 9.5 | 9.7 | 12.9 | 19.4 |
| | Number of inclusions with circle equivalent diameter of more than 5 μm [/cm$^2$] | 0.9 | 1.2 | 1.8 | 4.3 | 7.3 | 23.4 | 30.7 |

TABLE 5-continued

| | | Ex. 3-1 | Ex. 3-2 | Ex. 3-3 | Ex. 3-4 | Ex. 3-5 | Comp. Ex. 3-1 | Comp. Ex. 3-2 |
|---|---|---|---|---|---|---|---|---|
| Flattening film | Type | Phenyl group | Phenyl group | Phenyl group | Phenyl group | Phenyl group | Phenyl group | Phenyl group |
| | Film thickness [μm] | 0.3 | 0.3 | 0.3 | 0.3 | 0.3 | 0.3 | 0.3 |
| Evaluation | Number of measurement points of leakage current of 1 $\mu A/mm^2$ or more per 100 $cm^2$ [No.] | 6.4 | 6.5 | 6.8 | 7.5 | 8.3 | 29.0 | 29.0 |
| | Insulation reliability | Good | Good | Good | Good | Good | Poor | Poor |
| | Flatness | Good | Good | Good | Good | Good | Poor | Poor |

TABLE 6

| | | Ex. 4-1 | Ex. 4-2 | Ex. 4-3 | Ex. 4-4 | Ex. 4-5 | Comp. Ex. 4-1 | Comp. Ex. 4-2 |
|---|---|---|---|---|---|---|---|---|
| Stainless steel foil | Test material | Test Mat. 1-1 | Test Mat. 1-2 | Test Mat. 1-3 | Test Mat. 1-4 | Test Mat. 1-5 | Test Mat. 3-1 | Test Mat. 1-6 |
| | Sheet thickness [μm] | 5.0 | 10.0 | 25.0 | 50.0 | 100.0 | 50.0 | 50.0 |
| | $Al_2O_3$ [mass %] | 18.3 | 18.6 | 18.7 | 24.8 | 26.4 | 36.1 | 43.1 |
| | MgO [mass %] | 6.2 | 6.3 | 6.3 | 9.5 | 9.7 | 12.9 | 19.4 |
| | Number of inclusions with circle equivalent diameter of more than 5 μm [/$cm^2$] | 0.9 | 1.2 | 1.8 | 4.3 | 7.3 | 23.4 | 30.7 |
| Flattening film | Type | Methyl group | Methyl group | Methyl group | Methyl group | Methyl group | Methyl group | Methyl group |
| | Film thickness [μm] | 1.0 | 1.0 | 1.0 | 1.0 | 1.0 | 1.0 | 1.0 |
| Evaluation | Number of measurement points of leakage current of 1 $\mu A/mm^2$ or more per 100 $cm^2$ [No.] | 5.5 | 5.5 | 5.8 | 6.7 | 7.3 | 30.0 | 32.0 |
| | Insulation reliability | Good | Good | Good | Good | Good | Poor | Poor |
| | Flatness | Good | Good | Good | Good | Good | Poor | Poor |

TABLE 7

| | | Ex. 5-1 | Ex. 5-2 | Ex. 5-3 | Ex. 5-4 | Ex. 5-5 | Comp. Ex. 5-1 | Comp. Ex. 5-2 |
|---|---|---|---|---|---|---|---|---|
| Stainless steel foil | Test material | Test Mat. 2-1 | Test Mat. 2-2 | Test Mat. 2-3 | Test Mat. 2-4 | Test Mat. 2-5 | Test Mat. 4-1 | Test Mat. 2-6 |
| | Sheet thickness [μm] | 5.0 | 10.0 | 25.0 | 50.0 | 100.0 | 50.0 | 50.0 |
| | $Al_2O_3$ [mass %] | 25.7 | 25.9 | 26.1 | 27.4 | 28.5 | 35.1 | 47.8 |
| | MgO [mass %] | 7.9 | 8 | 8.1 | 8.8 | 9.4 | 11.3 | 20.5 |
| | Number of inclusions with circle equivalent diameter of more than 5 μm [/$cm^2$] | 5.5 | 5.7 | 5.9 | 7.3 | 8.8 | 27.2 | 35.9 |
| Flattening film | Type | Phenyl group | Phenyl group | Phenyl group | Phenyl group | Phenyl group | Phenyl group | Phenyl group |
| | Film thickness [μm] | 3.0 | 3.0 | 3.0 | 3.0 | 3.0 | 3.0 | 3.0 |
| Evaluation | Number of measurement points of leakage current of 1 $\mu A/mm^2$ or more per 100 $cm^2$ [No.] | 2.3 | 2.5 | 3.5 | 5.8 | 9.3 | 53.1 | 60.6 |
| | Insulation reliability | Good | Good | Good | Good | Good | Poor | Poor |
| | Flatness | Good | Good | Good | Good | Good | Poor | Poor |

TABLE 8

| | | Ex. 6-1 | Ex. 6-2 | Ex. 6-3 | Ex. 6-4 | Ex. 6-5 | Comp. Ex. 6-1 | Comp. Ex. 6-2 |
|---|---|---|---|---|---|---|---|---|
| Stainless steel foil | Test material | Test Mat. 2-1 | Test Mat. 2-2 | Test Mat. 2-3 | Test Mat. 2-4 | Test Mat. 2-5 | Test Mat. 4-1 | Test Mat. 2-6 |
| | Sheet thickness [μm] | 5.0 | 10.0 | 25.0 | 50.0 | 100.0 | 50.0 | 50.0 |
| | $Al_2O_3$ [mass %] | 25.7 | 25.9 | 26.1 | 27.4 | 28.5 | 35.1 | 47.8 |
| | MgO [mass %] | 7.9 | 8 | 8.1 | 8.8 | 9.4 | 11.3 | 20.5 |
| | Number of inclusions with circle equivalent diameter of more than 5 μm [/cm$^2$] | 5.5 | 5.7 | 5.9 | 7.3 | 8.8 | 27.2 | 35.9 |
| Flattening film | Type | Methyl group | Methyl group | Methyl group | Methyl group | Methyl group | Methyl group | Methyl group |
| | Film thickness [μm] | 1.0 | 1.0 | 1.0 | 1.0 | 1.0 | 1.0 | 1.0 |
| Evaluation | Number of measurement points of leakage current of 1 μA/mm$^2$ or more per 100 cm$^2$ [No.] | 3.0 | 3.6 | 4.5 | 5.9 | 9.4 | 57.1 | 63.4 |
| | Insulation reliability | Good | Good | Good | Good | Good | Poor | Poor |
| | Flatness | Good | Good | Good | Good | Good | Poor | Poor |

In each of Test Materials 1-1, 1-2, 1-3, 1-4, 1-5, 2-1, 2-2, 2-3, 2-4, and 2-5, $Al_2O_3$ is kept to a low 28.5 mass % or less and MgO to 9.7 mass % or less and there is little $Al_2O_3$ and MgO forming inclusions hard to break down by rolling, so the number of inclusions with a circle equivalent diameter of more than 5 μm is kept to a low 8.8/cm$^2$ or less. For this reason, the number of measurement points of leakage current of 1 μA/mm$^2$ or more per 100 cm$^2$ is a small 9.5 or less and, it is learned, the formation of cracks is reduced.

Further, the thinner the sheet thickness, the more the inclusions are broken down, the more reduced the mass % of $Al_2O_3$, the mass % of MgO, and the number of inclusions with a circle equivalent diameter of more than 5 μm, and, it is learned, the fewer the number of measurement points of leakage current of 1 μA/mm$^2$ or more per 100 cm$^2$ In the stainless steel foil of each of Test Materials 1-6 and 2-6, the reduction ratio in each pass is less than 20% and the inclusions are not broken down, so $Al_2O_3$ is contained in a large 43.1 mass % or more and MgO in 19.4 mass % or more and the number of inclusions with a circle equivalent diameter of more than 5 μm becomes a larger 30.7/cm$^2$ or more. For this reason, the number of measurement points of leakage current of 1 μA/mm$^2$ or more per 100 cm$^2$ is a large 32 or more and, for this reason, it is learned, the number of cracks formed is large.

Further, if compared with Test Materials 1-6 and 2-6, in each of Test Materials 1-1, 1-2, 1-3, 1-4, 1-5, 2-1, 2-2, 2-3, 2-4, and 2-5 produced by changing the rolling conditions, it is learned that the reduction ratio in each pass is 20% or more, the inclusions are broken down, the mass % of $Al_2O_3$, the mass % of MgO, and the number of inclusions with a circle equivalent diameter of more than 5 μm are reduced, and the number of inclusions with a circle equivalent diameter of more than 5 μm are reduced.

The stainless steel foil of each of Test Materials 3-1 and 4-1 contain $Al_2O_3$ in a large 35.1 mass % or more and MgO in 11.3 mass % or more. There is much $Al_2O_3$ and MgO forming inclusions hard to break up by rolling, so the number of inclusions with a circle equivalent diameter of more than 5 μm becomes a greater 23.4/cm$^2$ or more. For this reason, there are a large 30.0 or more measurement points of leakage current of 1 μA/mm$^2$ or more per 100 cm$^2$ and therefore, it is learned, the number of cracks formed is large.

As a result, in each of Test Materials 1 and 2, the content of Al or Mg can be suppressed. There is no entry of Al or Mg from the refractories like in the Test Materials 3 and 4, so it is learned that $Al_2O_3$ and MgO are reduced and the number of inclusions with circle equivalent diameters of more than 5 μm is decreased.

The invention claimed is:

1. A stainless steel foil with a flattening film, comprising, the stainless steel foil having a composition comprising stainless steel constituents and having a balance comprised of Fe and impurities, inclusions having particle diameter 2.00 μm or more comprising $Al_2O_3$: 30 mass % or less, with the exception of 0 mass %, and MgO: 10 mass % or less, with the exception of 0 mass %, with respect to a total mass of the particle diameter 2.00 μm or more inclusions, among the particle diameter 2.00 μm or more inclusions, the number of inclusions having particle diameter more than 5.00 μm present on the surface being 20/cm$^2$ or less, and having a sheet thickness of 5.0 μm or more and 100.0 μm or less, and the flattening film having a film thickness of 0.3 μm or more and 5.0 μm or less on at least one surface of the stainless steel foil, wherein the flattening film is a silica-based organic-inorganic hybrid film, and the Si nuclei forming the organic-inorganic hybrid film include only T nuclei and Q nuclei.

2. The stainless steel foil with a flattening film according to claim 1, wherein the stainless steel foil is austenitic stainless steel foil which has a composition comprising, by mass %, C: 0.150% or less,
Si: 0.050 to 2.000%,
Mn: 0.100 to 10.000%,
P: 0.045% or less,
S: 0.007% or less,
Ni: 2.000 to 15.000%,
Cr: 15.000 to 20.000%,
N: 0.200% or less,
Al: 0.030% or less,
Mg: 0.0005% or less, and
Ca: 0.0005% or less and
having a balance comprised of Fe and impurities.

3. The stainless steel foil with a flattening film according to claim 1, wherein the stainless steel foil is ferritic stainless steel foil which has a composition comprising, by mass %, C: 0.120% or less,
Si: 0.050 to 2.000%,
Mn: 0.100 to 1.250%,
P: 0.040% or less,
S: 0.030% or less,
Cr: 15.000 to 20.000%,
N: 0.025% or less,
Al: 0.030% or less,
Mg: 0.0005% or less, and
Ca: 0.0005% or less and
having a balance of Fe and impurities.

4. The stainless steel foil with a flattening film according to claim 1, wherein the flattening film is a silica-based organic-inorganic hybrid film and a ratio of Q nuclei with respect to the Si nuclei forming the organic-inorganic hybrid film is 70% or less.

5. The stainless steel foil with a flattening film according to claim 2, wherein the flattening film is a silica-based organic-inorganic hybrid film and a ratio of Q nuclei with respect to the Si nuclei forming the organic-inorganic hybrid film is 70% or less.

6. The stainless steel foil with a flattening film according to claim 3, wherein the flattening film is a silica-based organic-inorganic hybrid film and a ratio of Q nuclei with respect to the Si nuclei forming the organic-inorganic hybrid film is 70% or less.

7. The stainless steel foil according to claim 1, wherein the inclusions having particle diameter 2.00 μm or more comprises $Al_2O_3$: 1 to 30 mass % or less, and MgO: 1 to 10 mass %, with respect to a total mass of the particle diameter 2.00 μm or more inclusions.

8. The stainless steel foil according to claim 1, wherein the inclusions having particle diameter 2.00 μm or more comprises $Al_2O_3$: 3 to 30 mass %, and MgO: 3 to 10 mass %, with respect to a total mass of the particle diameter 2.00 μm or more inclusions.

9. The stainless steel foil according to claim 1, wherein the inclusions having particle diameter 2.00 μm or more comprises $Al_2O_3$: 5 to 30 mass %, and MgO: 5 to 10 mass %, with respect to a total mass of the particle diameter 2.00 μm or more inclusions.

* * * * *